United States Patent [19]

Biddle et al.

[11] Patent Number: 4,527,389

[45] Date of Patent: Jul. 9, 1985

[54] HIGHLY SOLUBLE, NON-HAZARDOUS HYDROXYLAMMONIUM SALT SOLUTIONS FOR USE IN HYBRID ROCKET MOTORS

[75] Inventors: Richard A. Biddle, Elkton, Md.; Ernest S. Sutton, Landenberg, Pa.

[73] Assignee: Thiokol Corporation, Chicago, Ill.

[21] Appl. No.: 390,570

[22] Filed: Jun. 21, 1982

[51] Int. Cl.[3] ..... C06D 5/00

[52] U.S. Cl. ..... 60/207; 149/45; 149/75

[58] Field of Search ..... 60/219, 220, 251, 254, 60/207; 149/45, 75

[56] References Cited

U.S. PATENT DOCUMENTS

| | | | |
|---|---|---|---|
| 3,068,641 | 12/1962 | Fox | 60/207 |
| 3,595,020 | 7/1971 | Schubert et al. | 60/207 |
| 3,668,872 | 6/1972 | Camp et al. | 60/251 |
| 3,700,393 | 10/1972 | Mueller | 149/75 |
| 3,882,673 | 5/1975 | Doin et al. | 60/207 |
| 4,066,736 | 1/1978 | Liggett | 423/386 |
| 4,141,768 | 2/1979 | Lo et al. | 149/19.6 |
| 4,332,631 | 6/1982 | Herty et al. | 60/207 |
| 4,402,775 | 9/1983 | Wood | 149/74 |

*Primary Examiner*—Edward A. Miller
*Attorney, Agent, or Firm*—Gerald K. White

[57] ABSTRACT

Non-hazardous, highly soluble hydroxylammonium salt solutions are disclosed. These solutions have utility as liquid oxidizers in solid/liquid hybrid rocket motors.

3 Claims, 1 Drawing Figure

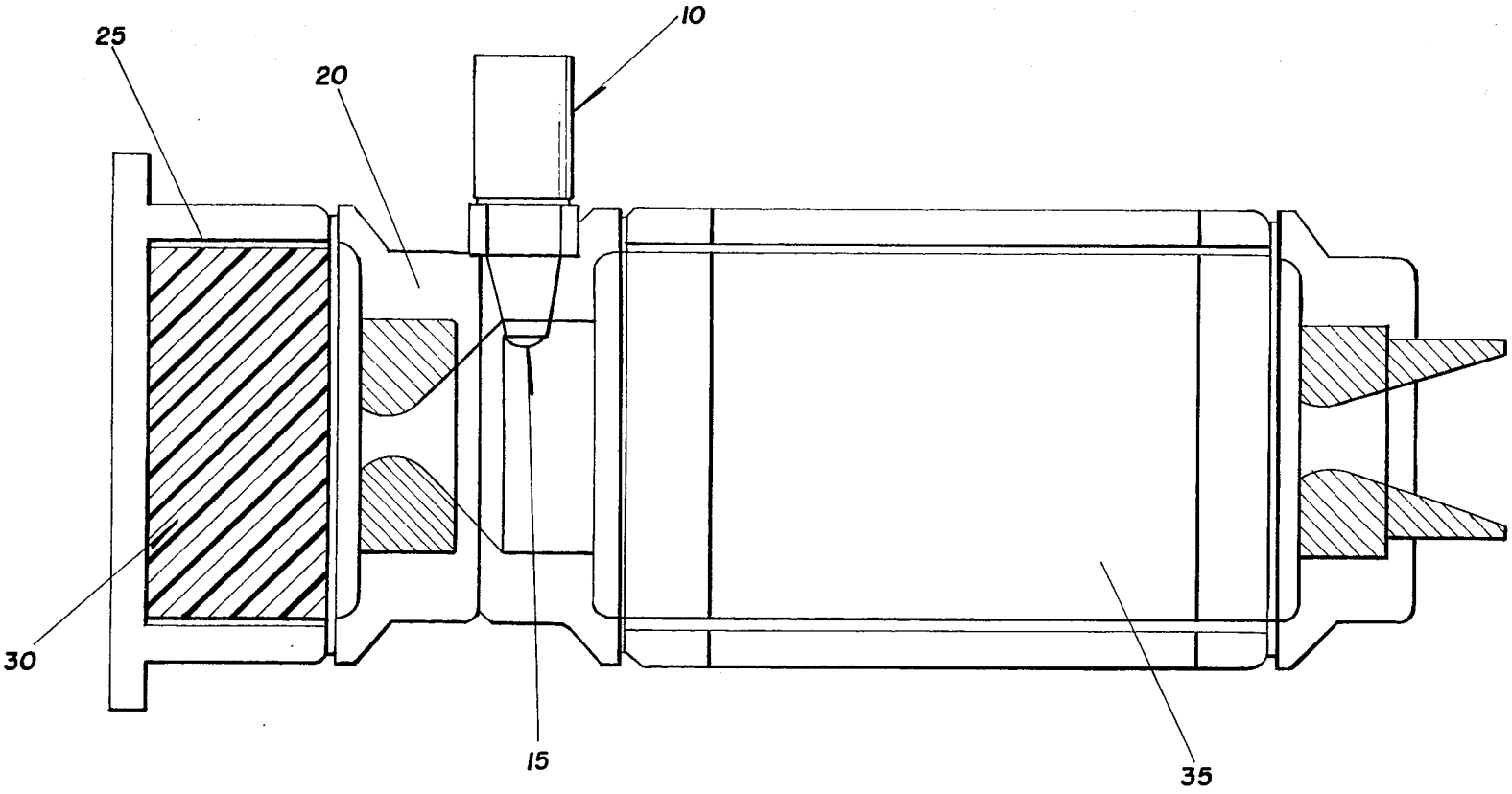
10
15
20
25
30
35

HIGHLY SOLUBLE, NON-HAZARDOUS HYDROXYLAMMONIUM SALT SOLUTIONS FOR USE IN HYBRID ROCKET MOTORS

BACKGROUND OF THE INVENTION

This invention relates to oxidizing solutions for use in liquid/solid hybrid rocket motors.

A liquid/solid hybrid rocket motor is a rocket motor in which a liquid is reacted with a gas formed by the combustion of a solid propellant to produce thrust. Two types of liquid/solid hybrid rocket motor are possible. The most common type of liquid/solid hybrid rocket motor employs a solid propellant which produces a fuel-rich gas and a liquid oxidizer. The second type of liquid/solid hybrid rocket motor employs a solid propellant which produces an oxidizing gas and employs a liquid reductant. This invention is applicable to liquid/-solid hybrid rocket motors which employ a liquid oxidizer.

Liquid/solid hybrid rocket motors may be classified by the reaction chamber in which the liquid reactant is reacted with the gas formed by the combustion of the solid propellant. A "primary chamber" liquid/solid hybrid rocket motor reacts the liquid reactant in the same reaction chamber which contains the solid propellant. A "secondary chamber" liquid/solid hybrid rocket motor reacts the liquid reactant in one or more "secondary" reaction chambers, which do not contain solid propellant. This invention is applicable to both primary chamber and secondary chamber liquid/solid hybrid rocket motors.

Liquid oxidizers are preferred over gaseous oxidizers because of volume limitations. A liquid oxidizer should possess several properties. It should react energetically and easily with the fuel. It should not be corrosive or require cryogenic temperatures to exist in the liquid state. It should not be hazardous during preparation or long-term storage. It should be stable over long-term storage. Reasonable viscosity is important since a liquid oxidizer must flow readily through piping and be capable of injection through a spray nozzle without the use of high pressure pumps.

Various liquid oxidizers have been considered for use in liquid/solid rocket motors, including liquid oxygen, liquid ozone, liquid fluorine, chlorine trifluoride ($ClF_3$), red fuming nitric acid, dinitrogen tetroxide, and hydrogen peroxide. There are safety, storage, or handling problems associated with each of these oxidizers. Liquid oxygen and liquid ozone require cryogenic storage and handling. Hydrogen peroxide, liquid fluorine, chlorine trifluoride, and red fuming nitric acid are corrosive and therefore require special materials, storage, and handling. Chlorine trifluoride will react spontaneously upon contact with air. Dinitrogen tetroxide will volatize unless external pressure is applied.

Hydroxylammonium salt solutions are commonly employed in the preparation of oximes from ketones or aldehydes and, in particular, the preparation of cyclohexanone oxime from cyclohexanone. See C. van de Moesdijk, "Cyclic Process For The Preparation And Processing Of A Hydroxyl-Ammonium Salt Solution," U.S. Pat. No. 4,328,198 (May 4, 1982).

DESCRIPTION OF THE DRAWING

The drawing is a schematic of a hybrid rocket motor used to test various oxidizing solutions injected into the motor. Injector 10 fitted with spray nozzle 15 is mounted in the nozzle assembly 20 fitted to a primary chamber 25 which contains a solid propellant grain 30 and which is joined to a secondary chamber 35.

DESCRIPTION OF THE INVENTION

The invention is a process for modulating the thrust of a liquid/solid hybrid rocket motor comprising injecting an oxidizing solution into the combustion gases of said motor wherein the oxidizing solution comprises water as the solvent and a hydroxylammonium salt as the solute.

It has been found that aqueous solutions of hydroxylammonium salts possess a combination of properties which make them ideal liquid oxidizers. These solutions are liquids at room temperature, non-hazardous, stable over long-term storage, and possess reasonable viscosity.

The hydroxylammonium salts can be readily synthesized by metathetical reactions involving commercially available hydroxylamine compounds and metal salt nitrates or perchlorates. For example, to prepare hydroxylammonium perchlorate on a 50 pound scale, a solution of 28.86 kg of barium perchlorate dissolved in 50 liters of water is added with stirring to a solution of 14.22 kg of hydroxylammonium sulfate dissolved in 100 liters of water. The reaction:

$$(NH_3OH)_2SO_4 + Ba(ClO_4)_2 \rightarrow 2NH_3OHClO_4 + BaSO_4$$

proceeds readily with the barium sulfate precipitation leaving an aqueous solution of hydroxylammonium perchlorate as the supernatant liquid. This solution can be concentrated by evaporation under reduced pressure to the desired concentration for use directly. Additional purification can be obtained by continued evaporation and crystallization of the perchlorate salt, followed by dissolution of the salt to form the desired concentration. Similar reactions can be used to prepare the hydroxylammonium nitrate salt solutions.

Other metathetical reactions such as those involving a volatile product can also be used to prepare the desired hydroxylammonium salt. In this type of reaction, $$NH_3OHCl + HClO_4 \rightarrow NH_3OHClO_4 + HCl$$

the volatile hydrogen chloride is removed by reduced pressure evaporation during the concentration process.

Hydroxylammonium nitrate (HAN) is commercially available as a 24% by weight aqueous solution prepared by an electrolytic process from Southwestern Analytical Chemicals, Inc., P.O. Box 485, Austin, Tex. 78767. This solution can be concentrated by carefully controlled vacuum evaporation to produce 90 percent by weight concentrations. While HAN aqueous solutions of greater than 90 percent are stable, these highly concentrated solutions may crystallize below 0° C. For general handling of HAN and HAP aqueous solutions, a concentration of 85% or less by weight is preferred.

The solubilities of various perchlorate and nitrate salts are compared in Table I below. The solubility data for the hydroxylammonium salts were generated by the applicants; the solubility data for the other perchlorate and nitrate salts were obtained from A. Seidel, "Solubilities, Inorganic and Metal-Organic Compounds," (4th ed. 1965).

TABLE I

COMPARATIVE SOLUBILITIES OF OXIDIZERS IN WATER

| | | Grams Solute per 100 g Solution at 25° C. | |
|---|---|---|---|
| | | Perchlorates ($ClO_4$—) | Nitrates ($NO_3$—) |
| Hydroxylammonium | $NH_3OH^+$ | 90.7 | 95 |
| Ammonium | $NH_4^+$ | 20.0 | 68.2 |
| Lithium | $Li^+$ | 37.5 | 45.8 |
| Sodium | $Na^+$ | 67.8 | 47.8 |
| Potassium | $K^+$ | 2.0 | 27.5 |

The viscosities of concentrated hydroxylammonium salt solutions are higher than the viscosity of water. However, these solutions flow readily and are spray nozzle injectable. Viscosities for representative hydroxylammonium nitrate solutions are listed in Table II below.

TABLE II

VISCOSITY OF HAN - $H_2O$ SOLUTIONS AT 25° C.

| % By Wt HAN | Density, g/cc | Viscosity, cp |
|---|---|---|
| 0.0 | 1.0 | 0.89 |
| 83.3 | 1.528 | 9.09 |
| 90.2 | 1.591 | 15.9 |
| 94.0 | 1.608 | 20.0 |

Hydroxylammonium salt solutions meet or exceed art-accepted standards for storage stability and safety. Table III lists various stability tests, accepted values, and test results, which are more fully brought out in the Examples.

TABLE III

SUMMARY OF STABILITY TEST RESULTS FOR AQUEOUS HAN SOLUTIONS

| | | HAN Concentration (%/wt) | | |
|---|---|---|---|---|
| Test | Accepted Value | 24.5 | 72.7 | 82.1 |
| Flash Point | over 75° C. | >87 | >87 | >87 |
| Autoignition Temperature | over 100° C. | >500 | >500 | >500 |
| Long-term Thermal stability | longer than 48 hours @ 75° C. | >48 | >48 | >48 |
| Impact Sensitivity | over 10 inches | 35 | 33 | 33 |
| Trauzl Block | below 8 cc/gram | 1.0 | 3.7 | 4.5 |

These hydroxylammonium salt solutions have utility as oxidizing liquids in a liquid/solid hybrid rocket motor. The operation of a secondary chamber liquid/solid hybrid rocket motor may be illustrated by referring to the drawing. A fuel rich solid propellant 30 is burned in primary chamber 25, producing thrust and exhaust gas which exits the primary chamber 25 through the primary chamber nozzle assembly 20. The secondary chamber 35 is maintained at a lower chamber pressure than the primary chamber by proper selection of nozzle diameters for the respective chambers. The exhaust gas is composed of suspended carbon particles and various gaseous components, including carbon monoxide, hydrogen, and methane. Injection of the liquid oxidizer into the primary exhaust nozzle assembly 20 through a spray nozzle 15 is controlled by a solenoid controlled on/off valve (not shown) connecting the liquid oxidizer reservoir (not shown) to the spray nozzle. The injected liquid oxidizer forms a curtain of liquid oxidizer through which the exhaust gas must pass. The hydroxylammonium salt reacts with the hydrogen, methane, carbon monoxide, and carbon particles contained in the exhaust gas, thereby producing additional thrust.

Results of exhaust gas composition calculations, employing 80% HMX polybutadiene as the solid propellant, burning in a primary chamber at 500 psia, and employing a solid propellant/liquid oxidizer ratio of 40/60, are set out in TABLE IV below.

TABLE IV

THEORETICAL EXHAUST COMPOSITIONS OF SECONDARY CHAMBER LIQUID/SOLID ROCKET MOTOR BEFORE AND DURING AQUEOUS HAN SOLUTION INJECTION

| | 80% HMX/ 20% HTPB | SOLID + 80% HAN | SOLID + 85% HAN |
|---|---|---|---|
| Gases, wt % | 89.26 | 100.0 | 100.0 |
| Mole Fraction | | | |
| $H_2$ | 0.321 | 0.187 | 0.168 |
| CO | 0.209 | 0.035 | 0.043 |
| $N_2$ | 0.192 | 0.209 | 0.220 |
| $CO_2$ | 0.068 | 0.189 | 0.185 |
| $H_2O$ | 0.043 | 0.380 | 0.384 |
| $CH_4$ | 0.008 | 0.000 | 0.000 |
| Solids, wt % | 10.74 | 0.00 | 0.00 |
| Mole Fraction, $C_{(s)}$ | 0.158 | 0.000 | 0.000 |

It is emphasized that the theoretical explanation of the increase in overall rocket motor thrust during liquid oxidizer injection is not meant to limit the allowable scope of the applicants' invention.

The use of hydroxylammonium salt solutions as the liquid oxidizer in a hybrid rocket motor is not limited to "secondary chamber" liquid/solid hybrid rocket motors. The aqueous hydroxylammonium salt solutions may be employed in primary chamber liquid/solid hybrid rocket motors as well. For most applications, secondary chamber injection is preferred because it allows a constant primary chamber pressure which allows a stable solid propellant burning rate.

The selection of solid propellant is not critical to the applicants' invention. Any solid propellant which produces a fuel-rich exhaust may be employed. Solid propellants are typically composed of an oxidizer dispersed throughout a polymeric binder. Various classes of oxidizers may be employed, including perchlorates, such as potassium perchlorate, ammonium perchlorate, and sodium perchlorate; nitrates, such as potassium nitrate, sodium nitrate, and ammonium nitrate; and both cyclic or linear nitramines. Cyclic nitramines, such as crystalline 1,3,5,7-tetramethylenetetranitramine, commonly known as HMX, and crystalline 1,3,5-trimethylenetrinitramine, commonly known as RDX, are preferred.

The hydroxylammonium oxidizing solution may be reacted with the fuel-rich solid propellant exhaust gas in a wide range of solid propellant/oxidizing solution ratios. Table V sets out results of theoretical calculations which indicate that an optimum solid propellant/oxidizing solution ratio is from 40/60 to 60/40 using a 85% hydroxylammonium salt concentration.

TABLE V

TYPICAL RESULTS OF THEORETICAL CALCULATIONS FOR 85% HYDROXYLAMMONIUM SALT SOLUTIONS USED WITH 80% HMX/20% HTPB SOLID PROPELLANT

| Salt | Ratio Solid/Liquid | $I_{VAC}$ (secs) |
|---|---|---|
| HAN | 70/30 | 261.0 |
| | 60/40 | 267.4 |
| | 50/50 | 272.9 |
| | 40/60 | 277.3 |
| | 30/70 | 271.0 |

TABLE V-continued

TYPICAL RESULTS OF THEORETICAL CALCULATIONS FOR 85% HYDROXYLAMMONIUM SALT SOLUTIONS USED WITH 80% HMX/20% HTPB SOLID PROPELLANT

| Salt | Ratio Solid/Liquid | $I_{VAC}$ (secs) |
|---|---|---|
| | 20/80 | 242.5 |
| | 10/90 | 205.9 |
| HAP | 70/30 | 260.7 |
| | 60/40 | 266.9 |
| | 50/50 | 272.1 |
| | 40/60 | 275.8 |
| | 30/70 | 263.3 |
| | 20/80 | 232.6 |
| | 10/90 | 193.1 |

The theoretical values set out above are dependent upon the concentration of the hydroxylammonium oxidizing salt solutions. The more concentrated the salt solution, the higher the vacuum impulse of a given solid propellant/liquid oxidizer ratio will be.

The Examples which follow are intended to illustrate the practice and advantages of the applicants' invention, and are not intended to limit the scope of their invention in any way. All percentages are measured by total weight of the solutions unless otherwise stated.

The solutions tested in Examples I through VI were prepared by the applicants under Contract DAAK11-78-C-0039, awarded to Thiokol Corporation by the Department of the Army. Actual testing of these solutions was performed by Hazards Research Corporation. Test data is reported in "Classification Of Liquid Gun Propellants And Raw Materials For Transportation And Storage," Contract Report ARBRL-CR-00454 (May, 1981), available from the Defense Technical Information Center.

EXAMPLE I

CLEVELAND OPEN CUP FLASH POINT DETERMINATION

The flash point is defined as the temperature at which a liquid or volatile solid gives off a vapor sufficient to form an ignitable mixture with the air surrounding the surface of the sample or within the test vessel. Various aqueous HAN solutions were evaluated pursuant to ASTM 92-72 (Cleveland Open Cup). In this method, a sample of the test material is gradually heated in an open container. At specified temperature intervals, a small test flame is passed across the container opening. The lowest temperature at which the application of the test flame across the surface of the test sample causes the vapors to ignite is taken as the flash point.

Materials which exhibit a flash point of at least 75° C. using the procedure of ASTM 92-72 are considered unlikely to ignite under conditions incident to storage and transportation. Tests results for aqueous HAN solutions are set out in TABLE VI below:

TABLE VI

| HAN Concentration | Flash Point |
|---|---|
| 24.5% | >87° C. |
| 72.7% | >87° C. |
| 82.1% | >87° C. |

EXAMPLE II

AUTOIGNITION TEMPERATURE DETERMINATION

The autoignition temperature is the lowest temperature at which the sample's vapors will spontaneously ignite in air. Autoignition temperature is dependent upon apparatus geometry and volume, and, to some extent, on sample charge volume. The most representative laboratory procedure is that of Setchkin (National Bureau of Standards). Materials which have a Setchkin autoignition temperature of over 100° C. are considered unlikely to ignite under conditions incident to storage and handling.

The Setchkin procedure employs a 1 liter spherical flask in a temperature-controlled bath or oven. A 0.05 cc sample is injected into the flask and the time required for ignition is recorded. (The appearance of a flash in the flask indicates ignition). The temperature is raised or lowered as appropriate and the procedure is repeated until the autoignition temperature—the lowest temperature at which the sample's vapors will spontaneously ignite in air—is determined.

Additional tests are conducted at the tentative autoignition temperature to determine whether different sample volumes produce different autoignition temperatures. If different sample volumes do produce different autoignition temperature values, the procedure is repeated until the true autoignition temperature is determined to ±5° C.

Test results for aqueous HAN solutions are set out in TABLE VII below:

TABLE VII

| HAN Concentration | Autoignition Temperature (Setchkin) |
|---|---|
| 24.5% | >500° C. |
| 72.7% | >500° C. |
| 82.1% | >500° C. |

EXAMPLE III

DEFLAGRATION POTENTIAL

Materials which do not deflagrate readily are considered unlikely to ignite under conditions incident to storage and transportation. Ten gram samples of HAN aqueous solutions were each placed in glass cups which were then sealed within stainless steel pressure vessels equipped with dual ignition sources consisting of a tightly coiled nichrome wire placed just under the sample surface and an electrically actuated pyrotechnic igniter ("Squib") aimed at the sample surface. Sequential ignition is employed: electric current is applied to the nichrome wire, which raises the temperature of the wire. If the sample does not ignite, the squib is fired. If no ignition takes place at ambient temperature and pressure, then temperature is raised to 70° C. and 250 psi nitrogen pressure is applied, and the test sequence is repeated.

Test results for aqueous HAN solutions are set out in TABLE VIII below:

TABLE VIII

| | Deflagration Potential | |
|---|---|---|
| HAN Concentration | Ambient Temperature & Pressure | 70° C. at 250 psi $N_2$ |
| 24.5% | no ignition | no ignition |
| 72.7% | no ignition | squib ignition |

TABLE VIII-continued

| HAN Concentration | Deflagration Potential: Ambient Temperature & Pressure | Deflagration Potential: 70° C. at 250 psi $N_2$ |
|---|---|---|
| 82.1% | no ignition | squib ignition |

EXAMPLE IV

JANNAF THERMAL STABILITY DETERMINATIONS

The JANNAF Thermal Stability test evaluates the response of a confined material to brief fire exposure. Materials which do not detonate in this test are considered unlikely to detonate under brief fire exposure.

A 0.5 milliliter sample is placed in a 0.22 inch diameter stainless steel cylinder 1.5 inches long. The cylinder is sealed with a 0.003 inch thick stainless steel diaphragm. The sealed cylinder is placed in a water bath which is heated at a rate of 10° C./minute.

The temperature at which the sample undergoes a "significant thermal activity" (ie., a chemical reaction such as decomposition, combustion, or detonation) is recorded. Test results for aqueous HAN solutions are set out in TABLE IX below:

TABLE IX

| HAN Concentration | Temperature of Significant Thermal Activity |
|---|---|
| 24.5% | 202° C./no detonation |
| 72.7% | 165° C./no detonation |
| 82.1% | 148° C./no detonation |

EXAMPLE V

LONG TERM THERMAL STABILITY

A fifty gram sample is placed in a glass cup with a 0.28 liter stainless steel pressure vessel which is then immersed in an oil bath maintained at 100° C. for 48 hours. If the sample undergoes rapid exothermic decomposition prior to the expiration of the test, a second sample is tested at 75° C. Survival of the second sample for 48 hours is considered to meet the requirements for a thermally stable material.

Test results for aqueous HAN solutions are set out in TABLE X below:

TABLE X

| HAN Concentration | Survival in Hours: 100° C. | Survival in Hours: 75° C. |
|---|---|---|
| 24.5% | >48 | — |
| 72.7% | >48 | — |
| 82.1% | 28.5 | >48 |

EXAMPLE VI

TRAUZL BLOCK DETONATION DETERMINATION

This test measures the explosive force generated by a given weight of sample. A glass vial containing the weighed sample is placed in a lead cylinder with 0.5 inch thick walls adjacent to a No. 8 blasting cap. The cap is electrically activated and the volume increase of the cylinder is recorded. The volume increase, less that obtained in a blank run, divided by the weight of sample gives the specific expansion in milliliters/gram.

Materials which exhibit specific expansion values below 8 ml/gram are considered non-detonable. Test results for aqueous HAN solutions are set out in TABLE XI below.

TABLE XI

| Concentration | Specific Expansion |
|---|---|
| 24.5% | 1.0 ml/gram |
| 72.7% | 3.7 ml/gram |
| 82.1% | 4.5 ml/gram |

EXAMPLE VII

SOLID/LIQUID HYBRID ROCKET MOTOR STATIC TESTS

The utility of the hydroxylammonium salt solution as a liquid oxidizer in solid/liquid rocket motors was demonstrated by injection of aqueous HAN solutions into a rocket motor during its operation under simulated altitude conditions (95,000 feet).

The solid propellant employed in the static tests was prepared from the following formulation:

| Component | Weight Percent |
|---|---|
| Hydroxyl terminated Polybutadiene (binder) | 18.35 |
| Isophorone diisocyanate (curing agent) | 1.60 |
| Thermax (opacifier) | 0.05 |
| HMX (oxidizer) | |
| Class 1 (220 micron weight mean diameter) | 56.00 |
| Class 5 (15 micron weight mean diameter) | 24.00 |

The static tests were conducted according to the following procedure using the drawing as a reference for the components involved. A nominal one pound, end-burning solid propellant grain in the primary chamber is ignited to produce a nominal 800 psia chamber pressure. The exhaust gases from the primary chamber pressurize in the secondary chamber to a nominal 80 psia level by the proper selection of nozzle throat diameters. The liquid injection valve, in line with the spray nozzle, is maintained closed during the first four seconds of motor operation to allow both chambers to achieve equilibrium pressure and to provide a baseline thrust for comparison with the injection mode. At the four second mark, the hydroxylammonium salt solution injection is begun by opening the injection valve. Injection through the spray nozzle continues for six seconds. At the ten second mark, the injection valve is closed. The solid propellant continues to burn for approximately ten seconds more, thereby providing additional baseline data.

TABLE XII

| Static Test No. PV1- | Liquid Injected | Solid/Liquid | Average Thrust (lbs.): Pre-Inj. | Inj. | Post Inj. | % Incr. | Percent Mass Flow Increase by Injection | Ratio Increased Thrust Increased Flow |
|---|---|---|---|---|---|---|---|---|
| 2539-4 | None | 100/0 | 10.6 | — | — | — | — | — |
| 2472-5 | 50% HAN | 49/51 | 9.7 | 18.6 | 10.7 | 82 | 104 | 0.79 |
| 2379-4 | 81% HAN | 63/31 | 9.8 | 18.4 | 10.6 | 80 | 59 | 1.36 |

TABLE XII-continued

| Static Test No. PV1- | Liquid Injected | Solid/ Liquid | Average Thrust (lbs.) Pre-Inj. | Inj. | Post Inj. | % Incr. | Percent Mass Flow Increase by Injection | Ratio Increased Thrust Increased Flow |
|---|---|---|---|---|---|---|---|---|
| 2472-6 | 81% HAN | 49/51 | 9.0 | 22.2 | 9.6 | 139 | 106 | 1.31 |
| 2379-3 | 81% HAN | 40/60 | 10.2 | 31.6 | 10.9 | 200 | 147 | 1.36 |
| 2539-2 | 81% HAN | 29/71 | 10.7 | 45.0 | 10.9 | 317 | 240 | 1.32 |

While Example VII employed only on/off, constant pressure injections of the aqueous hydroxylammonium nitrate solution, the rate of liquid injection may be varied, thereby providing throttleable solid/liquid rocket motor operation. Additionally, the injection may be started, turned off, then restarted again providing for multiple pulse mode operation of the hybrid rocket motor.

We claim:

1. A process for increasing the thrust of a rocket motor comprising a primary combustion chamber, a solid propellant grain within said primary chamber which generates combustion gas when ignited, a secondary combustion chamber aft of said primary chamber, and a passage connecting said primary and secondary chambers for conducting said combustion gas from said primary chamber to said secondary chamber, said process comprising the steps of:

(a) providing a supply of an aqueous solution comprising from 50% to 90% by weight of a hydroxylammonium salt selected from the group consisting of hydroxylammonium nitrate and hydroxylammonium perchlorate; and (b) contacting said combustion gas with said solution substantially within one of said passage and said secondary chamber at selected times, thereby reacting said combustion gas and said solution in said secondary chamber to increase thrust during said selected times.

2. The process of claim 1 wherein said solid propellant grain comprises crystalline 1,3,5,7-tetramethylenetetranitramine.

3. The process of claim 1 wherein said solid propellant grain comprises crystalline 1,3,5-trimethylenetrinitramine.

* * * * *